United States Patent [19]

Hanson et al.

[11] Patent Number: 4,909,182

[45] Date of Patent: Mar. 20, 1990

[54] ADHESIVE-APPLYING APPARATUS

[75] Inventors: Raymond Hanson, Rearsby; Malcolm Tillyard, Leicester, both of England

[73] Assignee: British United Shoe Machinery Ltd., Belgrave, United Kingdom

[21] Appl. No.: 346,640

[22] Filed: May 3, 1989

[30] Foreign Application Priority Data

Jun. 21, 1988 [GB] United Kingdom ..... 8814689

[51] Int. Cl.[4] ..... B05C 1/08; B05C 11/04

[52] U.S. Cl. ..... 118/692; 118/202; 118/244; 118/259; 118/261; 118/271

[58] Field of Search ..... 118/200, 202, 244, 258, 118/267, 271, 259, 261, 692; 427/430.1

[56] References Cited

U.S. PATENT DOCUMENTS 3,568,636 3/1971 Lockwood ..... 118/202
3,989,005 11/1976 Bowler et al. ..... 118/261
4,419,393 12/1983 Hanson ..... 427/430.1
4,465,015 8/1984 Osta et al. ..... 118/259
4,518,637 5/1985 Takeda et al. ..... 118/259
4,844,002 7/1989 Yasui et al. ..... 118/259

*Primary Examiner*—Willard Hoag

*Attorney, Agent, or Firm*—Owen J. Meegan; Aubrey C. Brine

[57] ABSTRACT

A nozzle having a flexible blade member with a flat adhesive-receiving surface in combination with a rotary transfer roll and side wall elements forms a reservoir for adhesive "upstream" (in the direction of roll rotation) of the line of contact of a straight edge of the surface with the roll surface, the arrangement being such that a layer of the adhesive, doctored by blade member to control its thickness and with its width controlled by the wall elements, is applied to the roll surface and carried thereby to the operating locality. An adhesive supply system is also provided for supplying adhesive to the reservoir, said system including a melting device for adhesive in solid form and pressure control means for controlling the pressure under which the adhesive is supplied.

57 Claims, 5 Drawing Sheets

ADHESIVE-APPLYING APPARATUS

BACKGROUND TO THE INVENTION

This invention is concerned with improvements in or relating to adhesive-applying apparatus whereby a layer of moisture-curable adhesive in a molten state can be applied to a surface portion of a workpiece presented to an operating locality of the apparatus.

There is described in U.S. Pat. No. No. 4,419,393 an adhesive-applying apparatus comprising a tapering block which constitutes a flexible blade member, said block terminating in a narrow spreading surface or spreading edge and one, adhesive-guiding, surface of the block being concave about an axis which extends transversely of the spreading edge, the arrangement being such that, when the adhesive-applying apparatus is in use, adhesive is supplied to the adhesive-guiding surface, which is arranged "upstream" (in terms of the direction of relative movement between the nozzle and a workpiece to which adhesive is being applied) of the spreading edge, whereby a pool of adhesive is formed within the confines of the concavity and the spreading edge acts to control the thickness of the adhesive layer applied to the workpiece.

In using such an apparatus, the workpiece is presented manually to the apparatus and thus, it will be appreciated, reliance must be placed upon the skill of the operator in controlling the pressure by which the workpiece is urged against the flexible blade member, which in turn controls the thickness of the applied layer of adhesive. Of course, as the operator becomes skilled, a consistent layer thickness becomes achievable, but initially achieving such consistency is difficult, especially in the case of presentation of an irregular non-flat workpiece, e.g. a shoe bottom, to the apparatus.

OBJECT OF THE INVENTION

It is thus the object of the present invention to provide an improved adhesive-applying apparatus in the operation of which reliance upon the operator's skill and dexterity for achieving consistency in the applied layer thickness is reduced.

SUMMARY OF THE INVENTION

The present invention provides adhesive-applying apparatus whereby a layer of moisture-curable adhesive in a molten state can be applied to a surface portion of a workpiece presented to an operating locality of the apparatus, said apparatus comprising a cylindrical transfer roll arranged at the operating locality, together with heating means for heating the transfer roll, and drive means for effecting rotation of the transfer roll, a flexible blade member terminating in a straight edge which is held in line contact engagement with the surface of the transfer roll, the "upstream" (in terms of the direction of rotation of the transfer roll) face of said member being inclined at an acute angle to a plane which lies tangential to the surface of the transfer roll and passes through the line of contact with the blade member, and two wall elements arranged one at either side of the blade member and extending "upstream" therefrom and sealingly engaging with the transfer roll, thus to form with the blade member and the surface of the transfer roll a reservoir to which molten adhesive can be supplied from a supply thereof and in which it can be contained, the arrangement being such that as the transfer roll is caused to rotate a layer of molten adhesive, the thickness of which is determined by the flexible blade member, is formed on the surface of the transfer roll and carried thereby to the operating locality.

It will thus be appreciated that, by the combination of a flexible blade member and a transfer roll firstly the applied pressure therebetween is now constant, or at least no longer dependent upon the pressure applied by the operator, so that the thickness of the adhesive layer applied to the transfer roll can be maintained consistent, and secondly the roll provides a surface with which the operator can more readily align the portion of a workpiece to which an adhesive layer is to be applied; this has been found especially suitable for the application of the adhesive layer to irregular surfaces such as the bottoms of shoes. Moreover, in the adhesive-applying apparatus in accordance with the invention, the formation of a reservoir of adhesive "upstream" (in terms of the direction of rotation of the transfer roll) of the flexible blade member can now be achieved with a more simply configured blade member acting in cooperation with the two wall elements and the surface of the transfer roll, and in particular the two wall elements more positively determine the width of the adhesive layer applied to the transfer roll. In this way, not only is the thickness of the adhesive layer applied to the shoe more controllable but also the width thereof.

It is of course desirable that the thickness of the adhesive-layer can be pre-set, e.g. according to the type of material to which it is applied, and to this end preferably blade member control means is provided whereby the force holding the flexible blade member in engagement with the transfer roll can be varied, thus to vary the thickness of the layer of molten adhesive formed on the surface of the transfer roll. More particularly, in a preferred embodiment of the apparatus the flexible blade member is in the form of a tapering block which terminates in said straight edge, and in this case the blade member control means conveniently comprises a presser member which is engageable with the "downstream" (in terms of the direction of rotation of the transfer roll) face of the blade member adjacent the straight edge thereof and is movable in a direction towards or away from the transfer roll.

The molten adhesive may be supplied to the reservoir in any suitable manner but, as in the case of the apparatus described in U.S. Patent Specification No. 4,419,393, preferably the flexible blade member is formed with an internal passageway connected to an adhesive supply and opening into said "upstream" face of the blade member. In this way, it will be appreciated, the blade member itself forms part of the adhesive supply system, and in particular forms the final part of that system. This is of course advantageous in that when the apparatus is left for an extended period and the "exposed" adhesive, i.e. the adhesive in the final part of the supply path, cures by exposure to atmosphere, the flexibility of the blade member, in which the final part is provided, enables the cured adhesive readily to be removed.

Further to facilitate the clearing of the adhesive supply path, conveniently the flexible blade member is supported in a mounting therefor, said mounting having an internal passageway which is aligned with the internal passageway of said member when the latter is supported in the mounting, the blade member and its mounting being provided with conical mating faces, and the apical angle of the projecting one of said faces being greater than that of the receiving one thus to form a seal about the junction of the internal passageways. In this way, as the flexible blade member is clamped in its mounting, the difference between the two apical angles causes an effective seal about the internal passageway of the flexible blade member. Furthermore, preferably a closure valve is provided in the internal passageway of the holder just "upstream" (in terms of the direction of adhesive flow) of the junction of the passageways, this valve thus providing a cut-off for the adhesive "downstream" of which any exposed, and thus cured, adhesive can be removed together with the blade member.

For ease of removing the cured adhesive from the flexible blade member, furthermore, conveniently the latter is split at its end remote from the straight edge to increase the access to the internal passageway formed therein.

The apparatus in accordance with the invention preferably further comprises adhesive supply means comprising a heated plate having one or more apertures formed therein, and presser means for causing engagement to take place under pressure between the heated plate and an end face of a block of solid adhesive thus progressively to melt the adhesive and cause the thus molten adhesive to flow through the aperture(s) for supply as aforesaid to the reservoir, pressure control means being provided for controlling the pressure applied by the presser means. Such pressure control means may include operator-actuatable means for varying the pressure to be applied.

Conveniently the presser means referred to above comprises a plunger and a reversible motor for effecting movement of the plunger, and the pressure control means comprises a pressure sensing device for controlling the operation of the motor. Moreover, rate control means is also preferably provided for controlling the operating speed of the motor and thus the rate at which the plunger is caused to move under the action of the motor; the rate control means may also be operator-actutable.

The end positions to which the plunger can be moved under the action of the motor are preferably determined by suitable means, e.g. limit switches. Moreover, conveniently in the operation of the apparatus actuation of the limit switch associated with the "no adhesive" end position (i.e. the position when the block of adhesive has been wholly melted or substantially so and supplied as aforesaid) is effective to initiate the return of the plunger to its other end position.

The transfer roll of the apparatus in accordance with the invention preferably comprises a core of a resilient material and an outer surface of a material which is hard in relation to the core material and to which the adhesive exhibits flow adhesion. Preferably the material forming the outer surface of the transfer roll is polyethylene and the material forming the core a silicone rubber. It has been found that, by providing core material of different hardnesses, it is possible, when applying adhesive up to the edge of a workpiece surface, accurately to locate the applied layer in relation to said edge and, if desired, indeed around it. By the provision of the outer surface as referred to above, it has been found that the thickness of the applied layer nevertheless remains consistent for core materials of different hardness, and also it has been found that, when a build-up of cured adhesive forms on the surface, it is possible to strip the cured adhesive therefrom.

Especially because of this latter feature, it is desirable that the transfer roll can be readily removed from the apparatus and to this end conveniently it is supported by a split shaft arrangement of which one shaft portion is connected to a motor forming part of the drive means for the transfer roll, and the other is mounted for pivotal movement into and out of a position of alignment with said one shaft portion. More particularly, the transfer roll is mounted on a tubular shaft which can be received on the pivotally mounted shaft portion and which has one end portion engageable with said one shaft portion by means of a pin-and-groove or like arrangement, a sleeve portion mounted on said one shaft portion serving to maintain said one end portion in operative engagement with said one shaft portion.

The wall elements by which the margins of the layer of adhesive transferred to the transfer roll are determined are preferably mounted in a carrier resiliently urged into engagement with the transfer roll; conveniently the presser member is also mounted on said carrier, for movement in a direction towards or away from the transfer roll as aforesaid. Furthermore, for facilitating access to the flexible blade member, conveniently the carrier is mounted for movement between an operative position, in which the wall elements lie at either side of the flexible blade member, and an out-of-the-way position.

Any suitable means may be provided for heating the transfer roll, but one convenient form of such heating means comprises a pipe which is connected to a hot air source and by which hot air can be directed on to the surface of the transfer roll. For convenience of construction, furthermore, the pipe may be secured to the carrier, or indeed the carrier may be mounted on the pipe, the pipe itself being mounted for pivotal movement in a frame portion of the apparatus.

BRIEF DESCRIPTION OF THE DRAWINGS

There now follows a detailed description, to be read with reference to the accompanying drawings, of one apparatus in accordance with the invention. It will of course be appreciated that this apparatus has been selected for description merely by way of exemplification of the invention and not by way of limitation thereof.

In the accompany drawings.

DESCRIPTION OF THE PREFERRED EMBODIMENT

Figure 1:
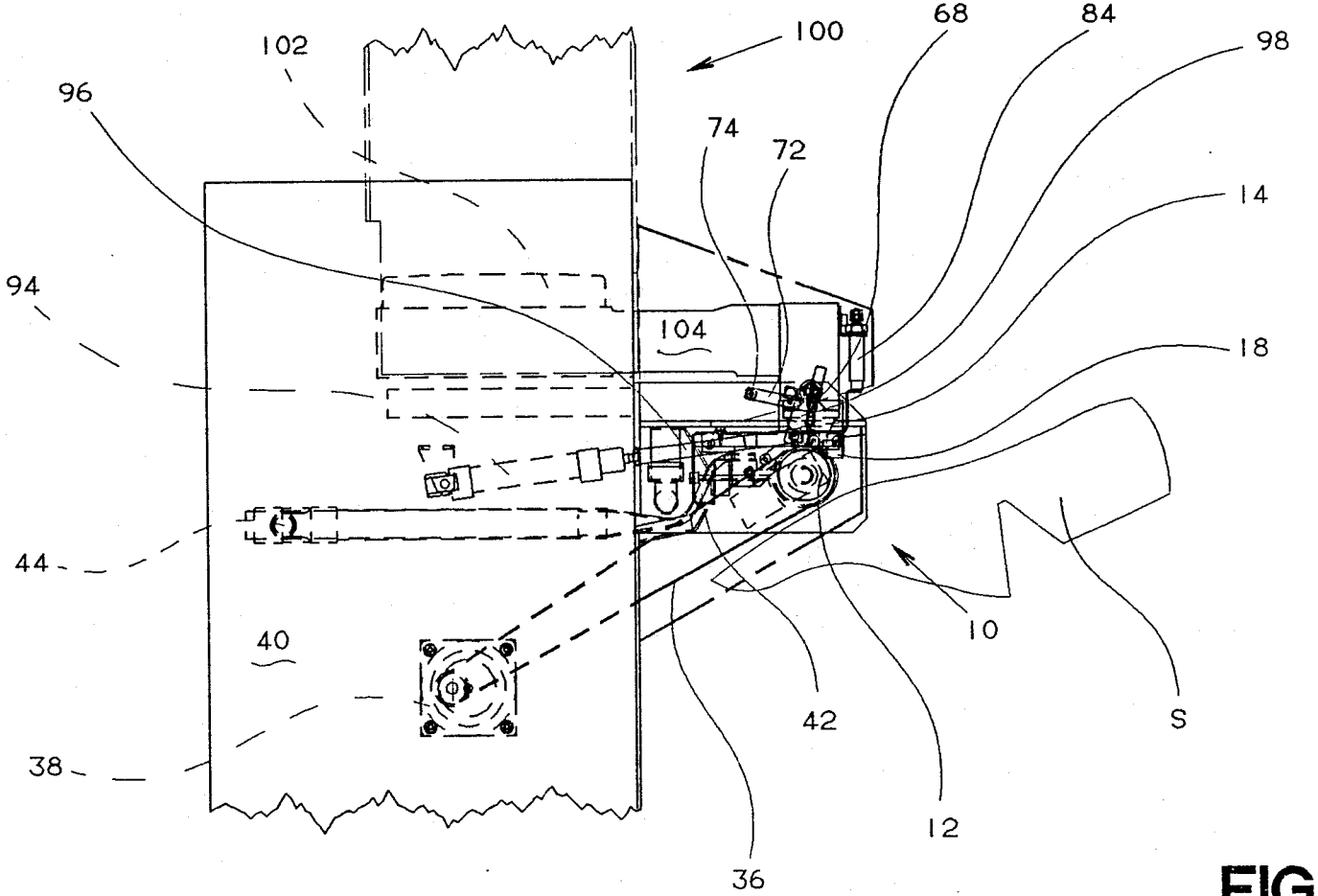
FIG. 1 is a view, in side elevation, of the apparatus in accordance with the invention, but omitting details of adhesive supply means thereof.

The apparatus now to be described is for use in the application of a layer of a moisture-curable adhesive in a molten state to a surface portion of a workpiece presented to an operating locality of the apparatus, and in particular, though not exclusively, for applying a layer of such adhesive to marginal portions of a lasted shoe bottom for the attachment of an outsole thereto. The apparatus thus comprises an operating locality generally designated 10 at which is arranged a transfer roll 12 and a nozzle 14 providing a flexible blade member 16 by which adhesive can be applied, in a layer of controlled thickness, to the surface of the transfer roll 12. In addition, the blade member 16 is flanked by two side wall elements 18, which operate to control the width of the layer of adhesive applied to the transfer roll 12. The blade member 16 and wall elements 18 are so arranged in relation to the transfer roll 12 as to form a reservoir into which molten adhesive can be supplied, as will be hereinafter described, and in which it can be contained, the arrangement being such that, as the roll 12 rotates, a layer of molten adhesive, doctored by the blade member 16, is carried on the surface of the roll to the operating locality.

The transfer roll 12 comprises a core 20 of resilient material and an outer, adhesive-receiving, layer or skin 22 which is hard in relation to the hardness of the core 20 and to which adhesive has low adhesion. Suitable materials for the core have been found to be silicone rubbers of an appropriate hardness. For an application in which it is desired to apply adhesive around the edge of the shoe bottom (or other workpiece surface) a relatively soft silicone rubber, with a hardness of 25 measured on the IRHD scale has been found satisfactory, while for applying the adhesive up to the edge of the workpiece surface a hardness of 45 on said scale has been found satisfactory, and for applications where it is essential to avoid cementing over the workpiece edge, a hardness of 65 measured on said scale affords the desired control.

A suitable material for the outer skin 22 of the transfer roll 12 has been found to be polyethylene, and in particular polyethylene tubing which can be shrunk onto the core 20. One such polyethylene is available from Hellermann Electric of Plymouth, Devon, England under the trade name "Helashrink".

The transfer roll 12 is constructed by mounting the core 20 on a tubular shaft 24 and securing washers 26 thereto, one at either side, whereafter the outer skin is shrunk over the core and washers. For mounting the transfer roll 12 in the apparatus, furthermore, a shaft 28 is provided, pivotally mounted on a frame portion 30 of the apparatus between an operative, horizontal, position and an out-of-the-way, loading, position, in which latter position the tubular shaft 24 of the roll 12 can be slid onto the shaft 28. Opposite the shaft 28, when in its operative position is a drive shaft 32 which carries a sleeve 34 spring-urged towards the shaft 28 but retractable by hand. The drive shaft 32 has, at its end, a diagonal plate-like projection which can be received in a correspondingly slotted end of the tubular shaft 24, thus to create a driving engagement between the shafts 24, 32, whereby the roll is driven. The sleeve 34, which is retracted to allow the shaft 28 to reach its operative position, is released to hold the shaft in said position and thus hold the transfer roll 12 in operative position and in driving engagement with the drive shaft 32. The drive shaft 32 is driven by a belt-and-pulley arrangement, including a belt 36, by means of a motor 38 mounted within a main housing 40 of the machine.

The transfer roll 12 is driven such that its forward surface portion, i.e. the surface portion closest to the operator, moves in a downward direction so that, in presenting the bottom of a shoe S to the roll, the operator moves the shoe in a generally straight line away from himself.

For heating the roll, thus to retain the adhesive applied thereto in a molten condition, heating means is provided in the form of a pipe 42 through which hot air can be directed towards the surface of the roll. The temperature of the air must be sufficient to maintain the adhesive molten but without creating damage to the outer skin 22 of the transfer roll, and it has been found that a temperature in the range 85° to 145° C. gives adequate results, an optimum temperature being in the order of 120° C. The hot air pipe 42, which is rigid, is supported in the main housing 40 for pivotal movement about a horizontal axis 44 extending widthwise of the housing, a suitable air connection being provided at the pivot point. The source of hot air may be provided by any suitable means.

In other apparatus in accordance with the invention the hot air pipe 42 may be fixed; the reason for its pivotal mounting in the present case will be explained hereinafter.

Figure 2:
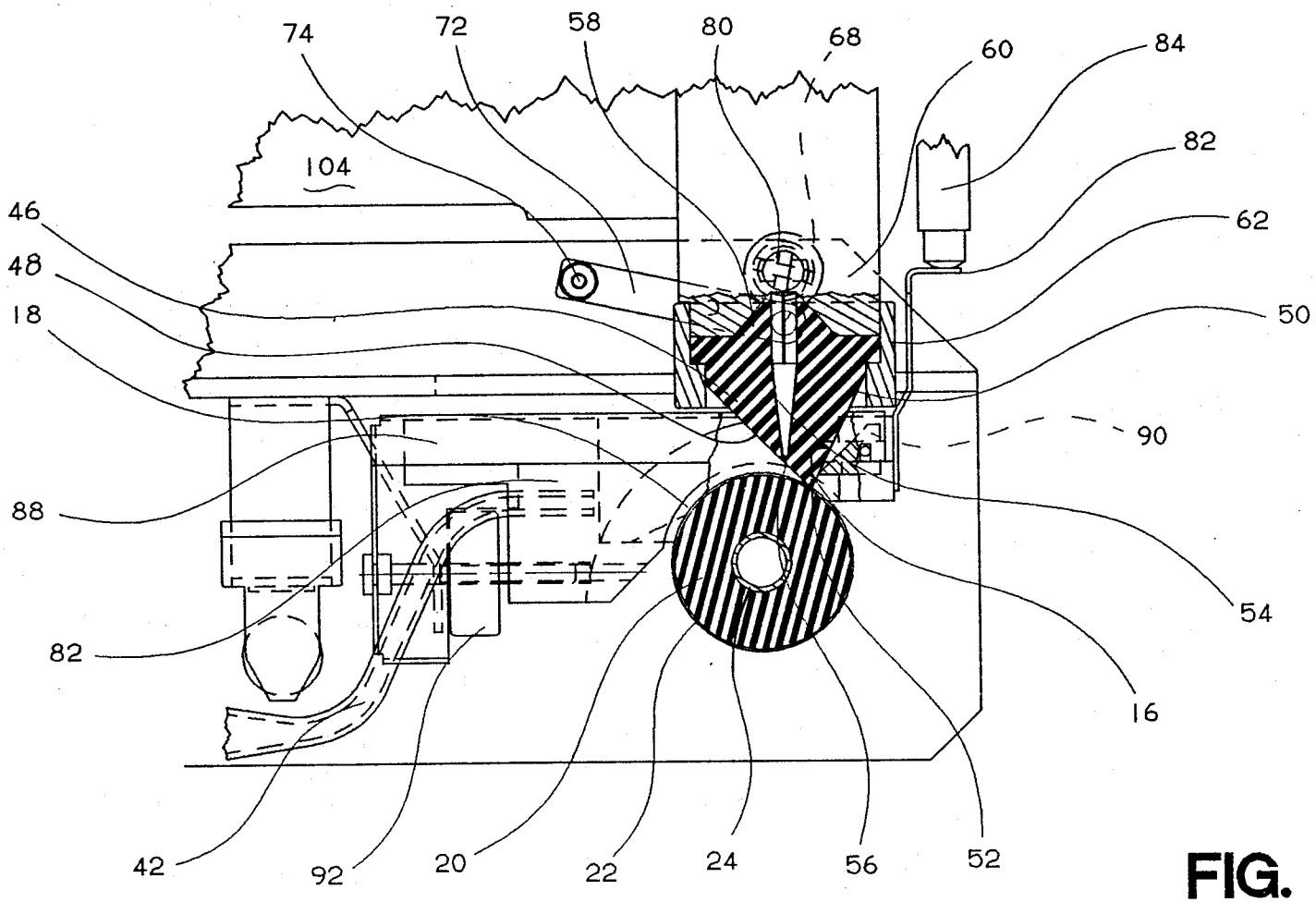
FIG. 2 is a section view, on an enlarged scale, showing details of a nozzle, transfer roll and wall elements of the apparatus.
Figure 3:
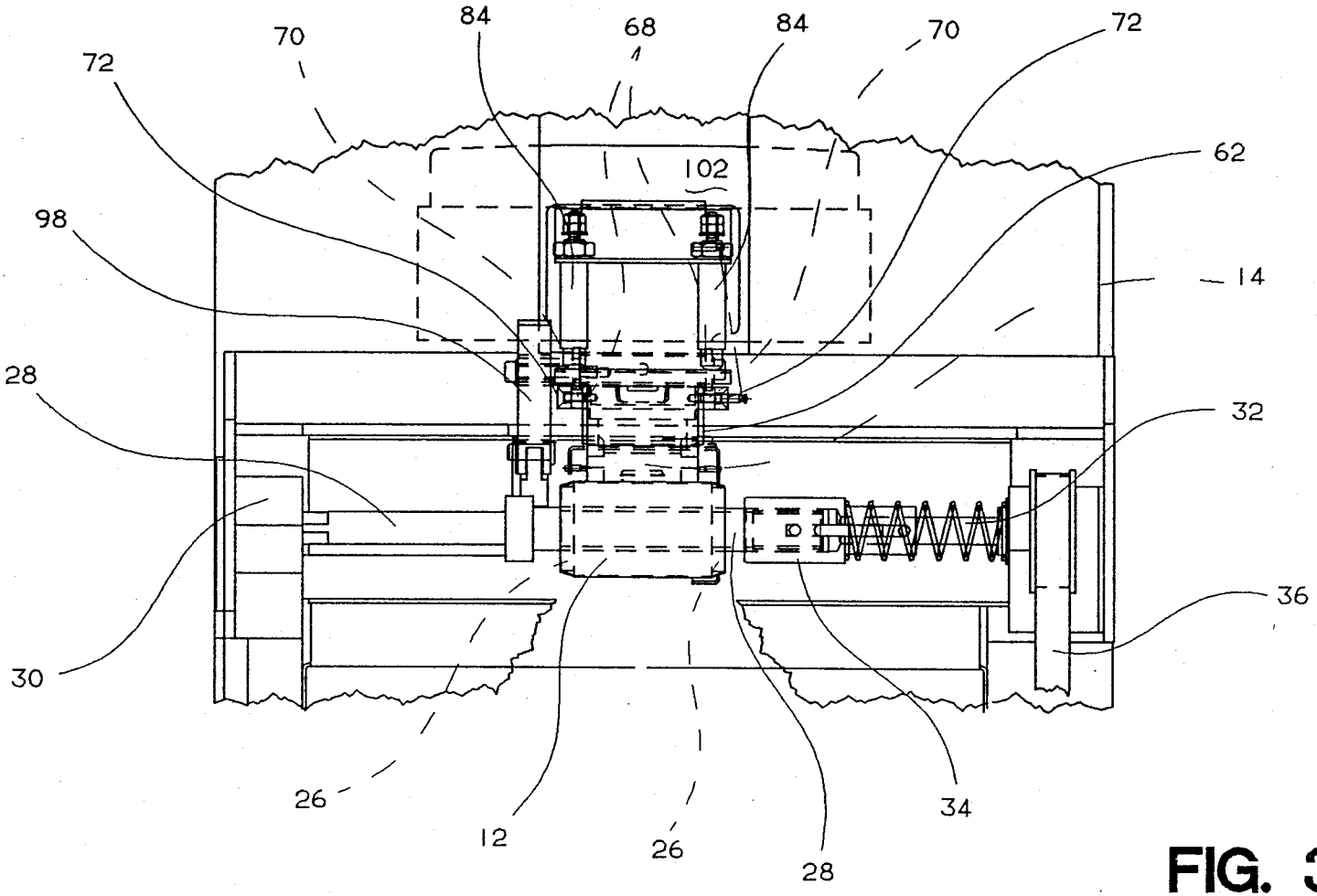
FIG. 3 is a detailed view, in front elevation, showing the mounting of the transfer roll.

For cooperating with the transfer roll 12 the blade member 16 is disposed thereabove (see FIG. 2), and comprises a body 46 of silicone rubber having two flat faces 48, 50 inclined at 70° to one another, and forming therebetween a straight edge 52, which is held (as will be referred to hereinafter) against the transfer roll surface. The straight edge 52 is arranged parallel to the axis of the transfer roll 12 and the "upstream" (in terms of the direction of rotation of the transfer roll 12) face 48 of the body 46 is inclined at an acute angle, preferably in the order of 45° to a plane extending tangentially to the surface of the transfer roll 12 and passing through the point of line contact engagement between said surface and the straight edge 52. Furthermore, as can be seen in FIG. 2, the straight edge is offset from the "top dead centre" of the transfer roll 12 by a short distance equivalent to a half of the roll radius; in the particular example, the diameter of the roll is 36 mm and the offset distance 10 mm.

In the operation of the apparatus, adhesive is supplied between the upstream face 48 of the body 46 and the surface of the transfer roll 12 and forms a pool or reservoir "upstream" of the straight edge, which latter edge acts as a doctor blade by which a layer of adhesive of controlled thickness is applied to the surface of the roll. For supplying adhesive to the reservoir the body 46 is formed with an internal passageway 54 which opens into the flat face 48 via a slot 56, though which adhesive can be supplied.

At the opposite end of the internal passageway 54 the body is formed with a conical portion 58 for seating in a correspondingly shaped conically recessed portion of a mounting 60, the apical angle of the conical portion 58 being a few degrees greater than of the conically recessed portion whereby, when the body 46 is forced into the mounting 60, a tight seal is formed about the outlet of the internal passageway 54. In this way, adhesive cannot leak between the body 46 and the mounting 60.

For holding the body 46 in the mounting 60 a ring 62 is provided which has a flanged portion cooperating with a flange formed on the body 46 and which has two diametrically opposed bayonet slots 66 engageable on pins 68 which project from the mounting 60. The pins have formed therein an intermediate eccentric portion 70 on which the bayonet slots 66 engage and means is provided for rotating the pins whereby to raise the ring 62 when secured on the pins 68 and thus clamp the body 46 in the mounting 60. The means for rotating the pins comprises two arms 72 mounted on projecting portions of the pins and being connected by a handle 74, the arrangement being such that, when the shaft 28 is in its out-of-the-way position, the arms can be pivoted through 180°, being of such a length that the handle 74 moves clear of the downwardly projecting nozzle 14. A spring (not shown) holds the arms at either end of their movement.

The mounting 60 is itself formed also with an internal passageway 76, to which reference will be made hereinafter, but in which, at the end immediately adjacent the conically recessed portion, is formed a cross-bore in which a rotary valve spool 80 is accommodated, the arrangement being such that, by rotating the spool through 90°, it is moved between an open and closed position. For thus rotating the spool an operator-actuatable treadle (not shown) is provided, actuation of which causes operation of a piston-and-cylinder arrangement 94 connected through a link 96 to a lever 98 fixedly connected to the rotary spool 80.

By virtue of this arrangement, if the adhesive in the nozzle body 46 cures, which may happen when the apparatus is left idle for an extended period, then the valve spool 80 forms a cut-off so that where exposed adhesive is not applied quickly and thus cures, the curing takes place only up to the spool 80 and it is only necessary to remove cured adhesive from the nozzle body 46.

For facilitating removal of cured adhesive from the body 46, furthermore, the conical portion 58 of the body is diagonally split, thereby facilitating the access of e.g. forceps to the cured adhesive for extracting it.

The hot air pipe 42 supports a carrier 82 for the two side wall elements 18, which are formed with arcuate engagement surfaces for sealingly engaging with the surface of the transfer roll 12. As already mentioned, the pipe 42, and thus the carrier 82, are pivotal about a horizontal axis 44, thus to move the side wall elements 18 to an out-of-the-way position, when it is desired to gain access to the nozzle body 46. In addition, it is desirable that the side wall elements 18 are spring-urged into engagement with the transfer roll surface. Thus, the carrier is urged downwardly by engagement with two spring plungers 84 carried by a housing for the nozzle 14 and, by engagement of the wall elements with the transfer roll, is maintained in its operative position. Movement of the shaft 28 to its out-of-the-way position thus allows the pipe 42 to pivot downwardly about its axis 44.

The carrier 82 also supports a slide 88 on which in turn is supported a presser member 90 constituting blade control means of the apparatus. The presser member engages the "downstream" face 50 of the body 46, adjacent, but slightly spaced from, the straight edge and urges the straight edge into line contact engagement with the transfer roll surface. It will be appreciated that the force exerted by the straight edge against the transfer roll will be dependent upon the position of the presser member 90 and this is adjustable by moving the slide 80 lengthwise of the carrier 82. To this end, a rotary knob 92 is held captive in the slide and in threaded engagement with the carrier so that rotation of the rod moves the slide lengthwise relative to the carrier and thus serves to position the presser member 90 in a desired relationship with the body 46 of the nozzle.

It will thus be appreciated that the "upstream" face 48 of the body 46 terminating in the straight edge 52, the side wall elements 18 and the surface of the transfer roll 12 together form a container or reservoir for adhesive supplied through the slot 56, and thus, as the transfer roll 12 rotates, a band or layer of adhesive is applied to the surface of the roll, the thickness of the layer being controlled by the straight edge, and indeed by the force applied to it, and the width of the layer being controlled by the side wall elements 18. It will of course also be appreciated that the hardness of the nozzle also influences the thickness of the applied layer and a suitable hardness for the nozzle, in general use, has been found to be in the range 50 to 60 measured on the IRHD scale.

When the operator applies adhesive, it is desirable that the speed at which he moves the workpiece surface, e.g. shoe bottom, should be approximately the same as the peripheral speed of the transfer roll 12. It is envisaged that an operator, operating normally, will move the shoe bottom at a speed equivalent to approximately 90 rpm roll speed (although the application of a consistent layer of adhesive to the surface of the transfer roll can be achieved at much higher roll speeds). The speed of rotation of the roll should preferably therefore lie in the range 75 to 100 rpm; a speed of 80 rpm has been found acceptable in most cases.

The apparatus in accordance with the invention also comprises adhesive supply means generally designated 100, said means being adapted to cooperate with cans of adhesive in solid form, which cans are provided with, in addition to a lid and a bottom, a further sliding circular plate, which initially lies adjacent the bottom of the can and which has sliding but sealing contact with the side walls of the can, the arrangement being that with the lid and bottom of the can removed, and with the open end of the can in sealing engagement with a heated plate or the like, application of pressure to the circular plate urges the leading end of the adhesive against the heated plate and melts it, but without allowing access to the adhesive by moisture from the atmosphere, which would of course serve to cure it.

Figure 4:
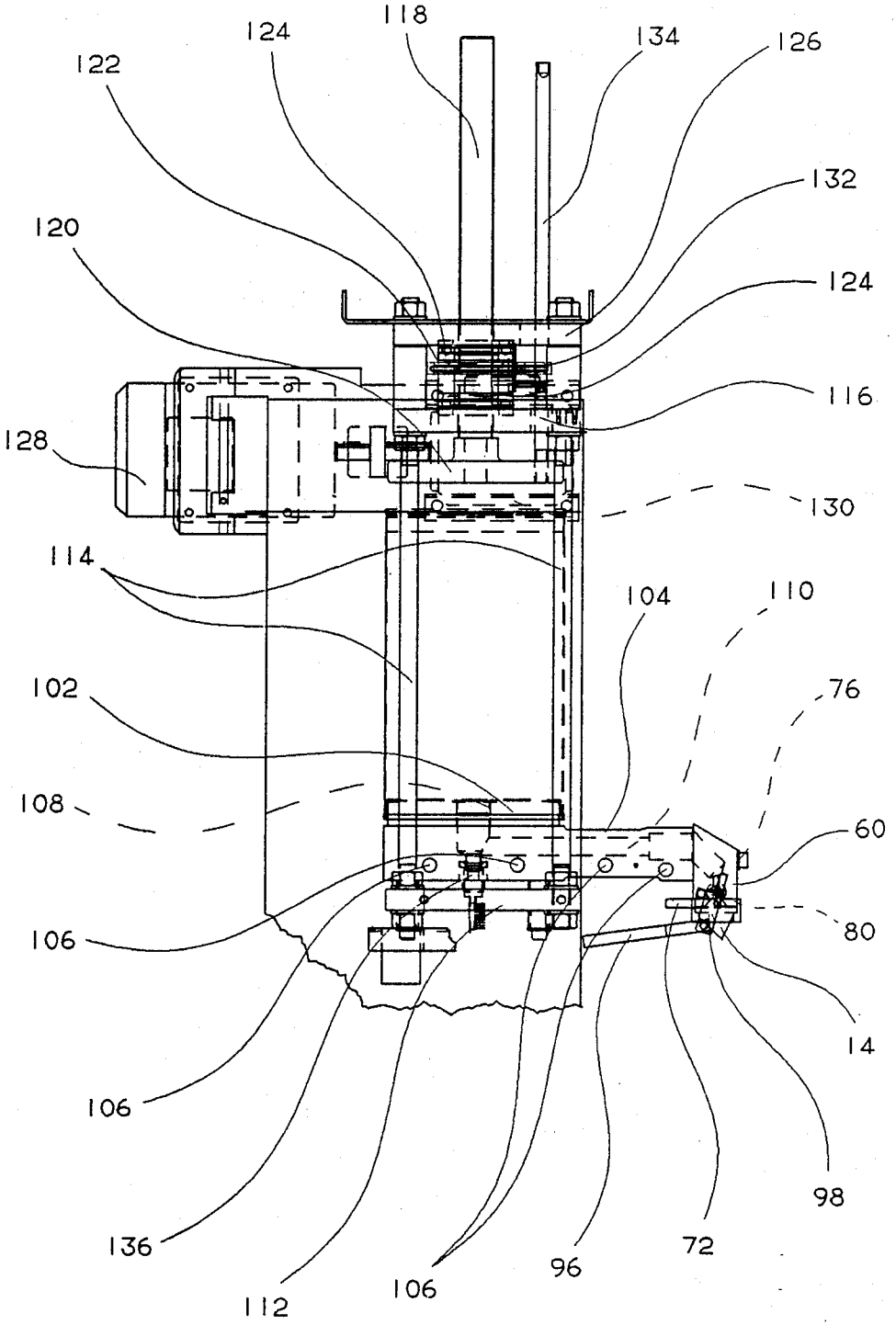
FIGS. 4 and 4A are respectively side and fragmentary front views, showing details of the adhesive supply means of the apparatus.
Figure 4A:
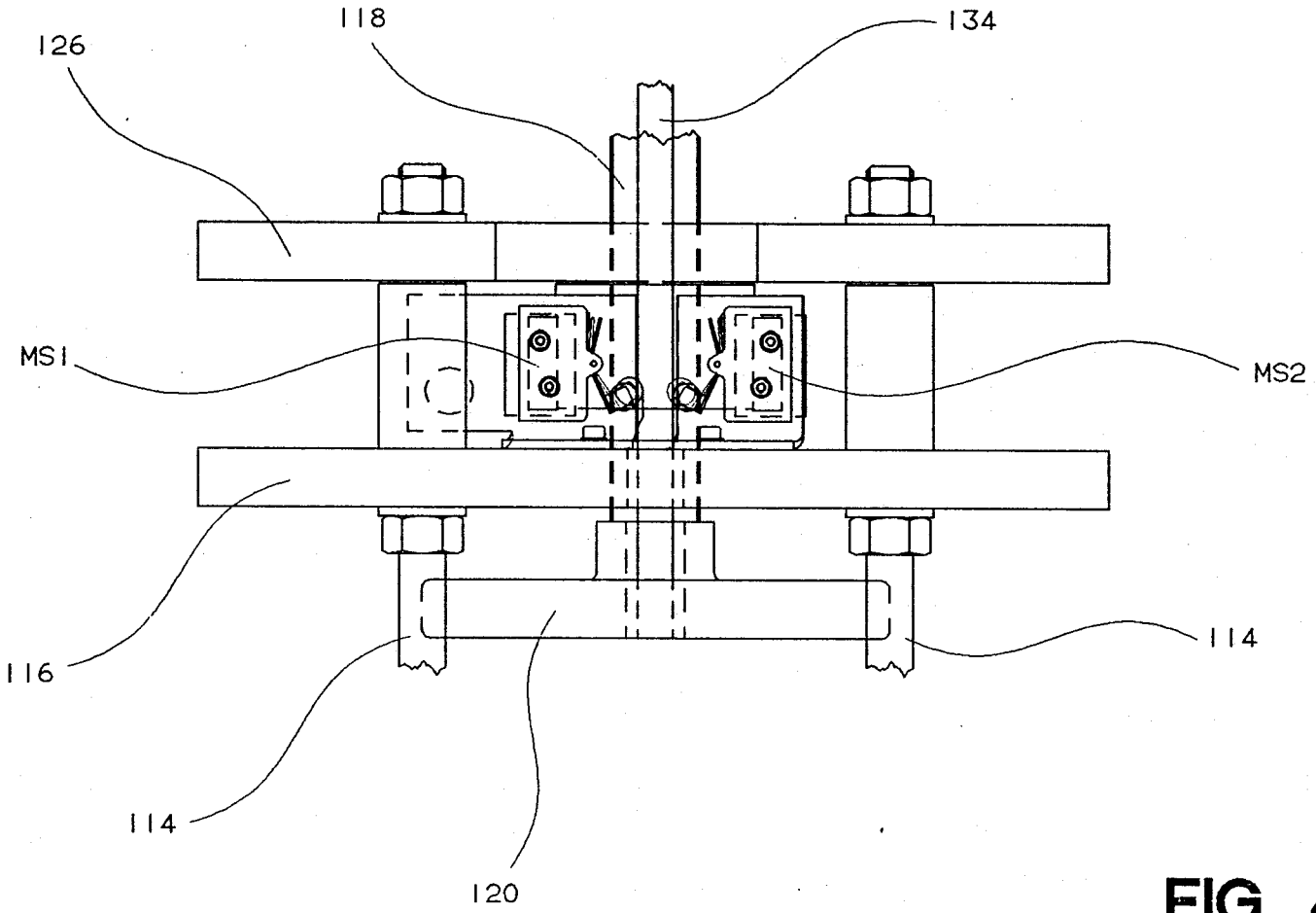

The adhesive supply means of the apparatus in accordance with the invention thus comprises a support plate 102 (FIG. 4) by which the can is supported, upside down, with the support plate accommodated within the lid end of the can and sealingly engaged therewith. The support plate is carried by an aluminium casting 104 in which electrical heaters 106 are embedded for heating the casting and thus the support plate; the support plate is made of steel. Formed within the support plate 102 is a central aperture 108 which is aligned with an inlet end of a passageway 110 which is formed in the casting 104 and terminates in the internal aperture 76 of the nozzle mounting 60. In this way, adhesive which is melted by engagement with the support plate 102 is supplied through the aperture 108 and passageways 110, 76 to the internal passageway 54 formed in the nozzle body 46.

The casting 104 is mounted on a base plate 112, forming part of the frame of the apparatus, and spaced from the base plate 112, by means of spacer rods 114, is a top plate 116, the arrangement being such that the distance between the base and top plates is sufficient to accommodate a can, e.g. a 5 liter can, therebetween. The top plate 116 provides a support for a threaded support rod 118 at the lower end of which is mounted a plunger 120, the rod and plunger forming part of presser means of the adhesive supply means of the apparatus. The plunger is so dimensioned as to fit in the upper end of the can and engage with the circular plate for applying pressure to the plate, and thus to the solid adhesive to urge it against the support plate 102.

For moving the plunger heightwise a drive element 122, which is in the form of an integral nut and sprocket, threadedly engages the support rod 118 and is held captive between thrust bearings 124 mounted between the top plate 116 and a cover plate 126. Thus by rotation of the drive element 122, the support rod 118 is moved heightwise. For rotating the drive element 122 a reversible motor 128 is mounted on the frame of the apparatus, said motor being connected through a gear box 130, which reduces the output speed of the motor to ⅛th, the output of the gear box being connected by a chain 132 to the drive element 122.

The adhesive supply means 100 also comprises pressure control means including a pressure transducer 136 mounted beneath the support plate 102 by which a signal can be supplied to a control unit (not shown) by which the operation of the motor 128 is controlled. More particularly, the control unit includes a digital display (not shown), indicating the pressure as sensed, and an operator-actuatable knob (also not shown), by which the desired pressure can be selected by the operator, the unit further providing pre-set upper and lower limits at either side of the selected pressure, and the arrangement being such that, upon reaching the lower limit, a drive signal is supplied to the motor to drive the plunger downwards, thus to increase the pressure, and, upon reaching the upper limit, a drive signal is provided to drive the plunger upwards to reduce the pressure. The control unit is a standard item obtainable from Digitron Instruments Ltd., Hertford, England.

The reversible motor 128 is driven through an inverter (also not shown) which receives the drive signals from the pressure control unit. The inverter is a standard item obtainable from IMO Ltd., London, England, under the designation "Jaguar Cub" and is operative to provide high torque on the motor at low operating speeds.

It will be appreciated that this combination of the motor drive with the pressure control unit could, under certain circumstances, cause the plunger 120 constantly to shunt between the upper and lower limits pre-set by the pressure control unit and in order to avoid this, therefore, it is desirable to control also the rate at which the plunger is driven. The adhesive supply means thus also comprises rate control means (not shown) including a knob controlling a rotary potentiometer, whereby the operating speed of the motor and thus the rate at which the plunger is caused to move under the action of the motor can be set; if desired, this rate control means may be operator-actuatable. The rate control means, it will be appreciated, serves through the inverter to vary the frequency supplied to the motor in order to vary its operating speed.

The movement of the plunger 120 is itself limited by upper and lower limit switches MS1, MS2, the lower limit switch MS2 being actuated when the plunger 120 reaches its lower limit and has thus expelled all the adhesive from the can, while the upper limit switch MS1 is actuated when the plunger has been raised clear of the can. The micro-switches are mounted on the machine frame for actuation by an actuator 134 mounted for movement with the plunger 120. Operation of the lower limit switch MS2 is effective to cause a signal to be supplied to the inverter which short-circuits the rotary potentiometer referred to above and applies full power to the motor to drive the plunger 120 upwards at full speed. In addition, an operator-actuatable switch (also not shown) is provided by which the motor can be operated at full speed to drive the plunger downwards into initial engagement with the circular plate of a new can of adhesive positioned in the apparatus.

It will thus be appreciated that the adhesive supply means 100 of the apparatus provides not only a means for melting adhesive appropriate to the requirements of operation, while avoiding exposure of adhesive to moisture in the atmosphere, but also, by controlling the pressure in the manner aforesaid, controls the rate of flow of the adhesive through the nozzle 14.

In using the apparatus in accordance with the invention described above, the surface of the transfer roll 12 will be maintained at the appropriate operating temperature by blowing hot air through the pipe 42 thereagainst and thus the adhesive layer on the roll will be maintained, albeit for a limited period, in its uncured state ready for application, but while the apparatus is not being used, the molten adhesive will be retained, under the pre-set pressure but not exposed to atmosphere, within the passageways 110 and 76. A pool of adhesive will of course be contained within the reservoir formed by the surface of the roll, the face 48 of the flexible blade member 16 and the side wall elements 18, and this adhesive will be curing, albeit slowly. When the operator wishes to apply adhesive to a workpiece surface, e.g. a shoe bottom, by operation of the treadle (not shown) the rotary valve spool 80 is rotated to allow adhesive to pass into the internal passageway 54 of the nozzle body 46, whereupon further adhesive is supplied to said pool and at the same time the operator presses the workpiece surface against the outer surface of the transfer roll and applies the layer of adhesive by moving the workpiece surface relative to the roll. At, or shortly before, the end of the application the operator releases the treadle whereupon the valve 80 reverts to its closed position.

We claim:

1. Adhesive-applying apparatus whereby a layer of moisture-curable adhesive in a molten state can be applied to a surface portion of a workpiece presented to an operating locality of the apparatus, said apparatus comprising a cylindrical transfer roll arranged at the operating locality, together with heating means for heating the transfer roll, and drive means for effecting rotation of the transfer roll, a flexible blade member terminating in a straight edge which is held in line contact engagement with the surface of the transfer roll, the "upstream" (in terms of the direction of rotation of the transfer roll) face of said member being inclined at an acute angle to a plane which lies tangential to the surface of the transfer roll and passes through the line of contact with the blade member, and two wall elements arranged one at either side of the blade member and extending "upstream" therefrom and sealingly engaging with the transfer roll, thus to form with the blade member and the surface of the transfer roll a reservoir to which molten adhesive can be supplied from a supply thereof and in which it can be contained, the arrangement being such that as the transfer roll is caused to rotate a layer of molten adhesive, the thickness of which is determined by the flexible blade member, is formed on the surface of the transfer roll and carried thereby to the operating locality.

2. Apparatus according to claim 1 wherein the transfer roll is supported by a split shaft arrangement of which one shaft portion is connected to a motor forming part of the drive means for the transfer roll, and the other is mounted for pivotal movement into and out of a position of alignment with said one shaft portion.

3. Apparatus according to claim 2 wherein the transfer roll is mounted on a tubular shaft which can be received on the pivotally mounted shaft portion and which has one end portion engageable with said one shaft portion by means of a pin-and-groove or like arrangement, a sleeve portion mounted on said one shaft portion serving to maintain said one end portion in operative engagement with said one shaft portion.

4. Apparatus according to claim 3 wherein the transfer roll comprises a core of a resilient material and an outer surface of a material which is hard in relation to the core material and to which the adhesive exhibits low adhesion.

5. Apparatus according to claim 1 wherein the transfer roll comprises a core of a resilient material and an outer surface of a material which is hard in relation to the core material and to which the adhesive exhibits low adhesion.

6. Apparatus according to claim 5 wherein the material forming the outer surface of the transfer roll is polyethylene.

7. Apparatus according to claim 5 wherein the material forming the core of the transfer roll is a silicone rubber.

8. Apparatus according to claim 7 wherein the material forming the outer surface of the transfer roll is polyethylene.

9. Apparatus according to claim 1 wherein the wall elements are mounted in a carrier resiliently urged into engagement with the transfer roll.

10. Apparatus according to claim 9 wherein the carrier is mounted for movement between an operative position, in which the wall elements lie at either side of the flexible blade member, and an out-of-the-way position.

11. Apparatus according to claim 9 wherein blade member control means is provided whereby the force holding the flexible blade member in engagement with the transfer roll can be varied, thus to vary the thickness of the layer of molten adhesive formed on the surface of the transfer roll, and wherein the flexible blade member is in the form of a tapering block which terminates in said straight edge and the blade member control means comprises a presser member which is engageable with the "downstream" (in terms of the direction of rotation of the transfer roll) face of the blade member adjacent the straight edge thereof and is movable in a direction towards or away from the transfer roll, and also wherein the presser member is mounted on said carrier for movement in a direction towards or away from the transfer roll.

12. Apparatus according to claim 11 wherein the transfer roll comprises a core of a resilient material and an outer surface of a material which is hard in relation to the core material and to which the adhesive exhibits low adhesion.

13. Apparatus according to claim 11 wherein the carrier is mounted for movement between an operative position, in which the wall elements lie at either side of the flexible blade member, and an out-of-the-way position.

14. Apparatus according to claim 1 wherein the heating means for the transfer roll comprises a pipe which is connected to a hot air source and by which hot air can be directed on to the surface of the transfer roll.

15. Apparatus according to claim 14 wherein the wall elements are mounted in a carrier resiliently urged into engagement with the transfer roll, and wherein said pipe is secured to the carrier.

16. Apparatus according to claim 15 wherein blade member control means is provided whereby the force holding the flexible blade member in engagement with the transfer roll can be varied, thus to vary the thickness of the layer of molten adhesive formed on the surface of the transfer roll, and wherein the flexible blade member is in the form of a tapering block which terminates in said straight edge and the blade member control means comprises a presser member which is engageable with the "downstream" (in terms of the direction of rotation of the transfer roll) face of the blade member adjacent the straight edge thereof and is movable in a direction towards or away from the transfer roll, and also wherein the presser member is mounted on said carrier for movement in a direction towards or away from the transfer roll.

17. Apparatus according to claim 16 wherein the carrier is mounted for movement between an operative position, in which the wall elements lie at either side of the flexible blade member, and an out-of-the-way position.

18. Apparatus according to claim 17 wherein the flexible blade member is secured in a mounting by means of a quick release fitting on which the blade member can readily be secured and wherein means is provided for moving said fitting towards the mounting thus to clamp the flexible blade member secured thereon tightly in its mounting.

19. Apparatus according to claim 1 wherein blade member control means is provided whereby the force holding the flexible blade member in engagement with the transfer roll can be varied, thus to vary the thickness of the layer of molten adhesive formed on the surface of the transfer roll.

20. Apparatus according to claim 19 wherein the flexible blade member is in the form of a tapering block which terminates in said straight edge and the blade member control means comprises a presser member which is engageable with the "downstream (in terms of the direction of rotation of the transfer roll) face of the blade member adjacent the straight edge thereof and is movable in a direction towards or away from the transfer roll.

21. Apparatus according to claim 20 wherein the flexible blade member is made of a silicone rubber.

22. Apparatus according to claim 20 wherein for supplying molten adhesive to the reservoir the flexible blade member is formed with an internal passageway connected to an adhesive supply and opening into said "upstream" face of the blade member, and wherein the flexible blade member is supported in a mounting therefor, said mounting having an internal passageway which is aligned with the internal passageway of said member when the latter is supported in the mounting.

23. Apparatus according to claim 22 wherein the blade member and its mounting are provided with conical mating faces, the apical angle of the projecting one of said faces being greater than that of the receiving one thus to form a seal about the junction of the internal passageways.

24. Apparatus according to claim 22 wherein the flexible blade member is made of a silicone rubber.

25. Apparatus according to claim 24 wherein the blade member is split at its end remote from the straight edge to increase the access to the internal passageway formed therein.

26. Apparatus according to claim 1 wherein the flexible blade member is secured in a mounting by means of a quick release fitting on which the blade member can readily be secured, and wherein means is provided for moving said fitting towards the mounting thus to clamp the flexible blade member secured thereon tightly in its mounting.

27. Apparatus according to claim 26 wherein the wall elements are mounted in a carrier resiliently urged into engagement with the transfer roll, the presser member also being mounted on said carrier for movement in a direction towards or away from the transfer roll, and wherein the heating means for the transfer roll comprises a pipe which is connected to a hot air source and by which hot air can be directed on to the surface of the transfer roll, said pipe also being secured to the carrier.

28. Apparatus according to claim 27 wherein the carrier is mounted for movement between an operative position, in which the wall elements lie at either side of the flexible blade member, and an out-of-the-way position.

29. Apparatus according to claim 26 wherein the blade member and its mounting are provided with conical mating faces, the apical angle of the projecting one of said faces being greater than that of the receiving one thus to form a seal about the junction of the internal passageways.

30. Apparatus according to claim 29 wherein for supplying molten adhesive to the reservoir the flexible blade member is formed with an internal passageway connected to an adhesive supply and opening into said "upstream" face of the blade member, and wherein the flexible blade member is supported in a mounting therefor, said mounting having an internal passageway which is aligned with the internal passageway of said member when the latter is supported in the mounting.

31. Apparatus according to claim 30 wherein the blade member is split at its end remote from the straight edge to increase the access to the internal passageway formed therein.

32. Apparatus according to claim 31 wherein the flexible blade member is made of a silicone rubber.

33. Apparatus according to claim 1 wherein adhesive supply means is also provided comprising a heated plate having one or more apertures formed therein, and presser means for causing engagement to take place under pressure between the heated plate and an end face of a block of solid adhesive thus progressively to melt the adhesive and cause the thus molten adhesive to flow through the aperture(s) for supply as aforesaid to the reservoir, and wherein pressure control means is provided for controlling the pressure applied by the presser means.

34. Apparatus according to claim 33 wherein for supplying molten adhesive to the reservoir the flexible blade member is formed with an internal passageway connected to an adhesive supply and opening into said "upstream" face of the blade member, wherein the flexible blade member is supported in a mounting therefor, said mounting having an internal passageway which is aligned with the internal passageway of said member when the latter is supported in the mounting, and wherein the or each aperture is connected to the internal passageway of the mounting for the flexible blade member and the molten adhesive is caused to flow through the aperture(s) into said internal passageway.

35. Apparatus according to claim 33 wherein the pressure control means includes operator-actuatable means for varying the pressure to be applied.

36. Apparatus according to claim 33 wherein the presser means comprises a plunger and a reversible motor for effecting movement of the plunger, and wherein the pressure control means comprises a pressure sensing device for controlling the operation of the motor.

37. Apparatus according to claim 36 wherein rate control means is provided for controlling the operating speed of the motor and thus the rate at which the plunger is caused to more under the action of the motor.

38. Apparatus according to claim 36 wherein for supplying molten adhesive to the reservoir the flexible blade member is formed with an internal passageway connected to an adhesive supply and opening into said "upstream" face of the blade member, and wherein the flexible blade member is supported in a mounting therefor, said mounting having an internal passageway which is aligned with the internal passageway of said member when the latter is supported in the mounting, and also wherein the or each aperture is connected to the internal passageway of the mounting for the flexible blade member and the molten adhesive is caused to flow through the aperture(s) into said internal passageway.

39. Apparatus according to claim 38 wherein limit switches are provided for determining the end positions to which the plunger can be moved under the action of the motor.

40. Apparatus according to claim 39 wherein actuation of the limit switch associated with a "no adhesive" end position (i.e. the position when the block of adhesive has been wholly melted or substantially so and supplied as aforesaid) is effective to initiate the return of the plunger to its other end position.

41. Apparatus according to claim 40 wherein the pressure control means includes operator-actuatable means for varying the pressure to be applied.

42. Apparatus according to claim 41 wherein rate control means is provided for controlling the operating speed of the motor and thus the rate at which the plunger is caused to move under the action of the motor.

43. Apparatus according to claim 1 wherein for supplying molten adhesive to the reservoir the flexible blade member is formed with an internal passageway connected to an adhesive supply and opening into said "upstream" face of the blade member.

44. Apparatus according to claim 43 wherein the blade member is split at its end remote from the straight edge to increase the access to the internal passageway formed therein.

45. Apparatus according to claim 44 wherein the flexible blade member is made of a silicone rubber.

46. Apparatus according to claim 43 wherein the flexible blade member is supported in a mounting therefor, said mounting having an internal passageway which is aligned with the internal passageway of said member when the latter is supported in the mounting.

47. Apparatus according to claim 46 wherein the blade member is split at its end remote from the straight edge to increase the access to the internal passageway formed therein.

48. Apparatus according to claim 47 wherein the flexible blade member is made of a silicone rubber.

49. Apparatus according to claim 46 wherein the blade member and its mounting are provided with conical mating faces, the apical angle of the projecting one of said faces being greater than that of the receiving one thus to form a seal about the junction of the internal passageways.

50. Apparatus according to claim 49 wherein the flexible blade member is made of a silicone rubber.

51. Apparatus according to claim 46 wherein a closure valve is provided in the internal passageway of the holder just "upstream" (in terms of the direction of adhesive flow) of the junction of the passageways.

52. Apparatus according to claim 51 wherein the blade member is split at its end remote from the straight edge to increase the access to the internal passageway formed therein.

53. Apparatus according to claim 51 wherein the blade member and its mounting are provided with conical mating faces, the apical angle of the projecting one of said faces being greater than that of the receiving one thus to form a seal about the junction of the internal passageways.

54. Apparatus according to claim 53 wherein the flexible blade member is secured in its mounting by means of a quick release fitting on which the blade member can readily be secured, and wherein means is provided for moving said fitting towards the mounting thus to clamp the flexible blade member secured thereon tightly in its mounting.

55. Apparatus according to claim 54 wherein the flexible blade member is made of a silicone rubber.

56. Apparatus according to claim 55 wherein blade member control means is provided whereby the force holding the flexible blade member in engagement with the transfer roll can be varied, thus to vary the thickness of the layer of molten adhesive formed on the surface of the transfer roll.

57. Apparatus according to claim 56 wherein the flexible blade member is in the form of a tapering block which terminates in said straight edge and the blade member control means comprises a presser member which is engageable with the "downstream" (in terms of the direction of rotation of the transfer roll) face of the blade member adjacent the straight edge thereof and is movable in a direction towards or away from the transfer roll.

* * * * *